US006056282A

United States Patent [19]

Desmarais

[11] Patent Number: 6,056,282

[45] Date of Patent: May 2, 2000

[54] CLAMPING DEVICE

[76] Inventor: Carey Desmarais, #93 1133 Pipeline Road, Coquitlam, B.C., Canada, V3B 4R8

[21] Appl. No.: 09/057,758

[22] Filed: Apr. 9, 1998

[51] Int. Cl.[7] ..... B25B 1/20

[52] U.S. Cl. ..... 269/37; 269/152

[58] Field of Search ..... 269/37, 152, 254 CS, 269/64

[56] References Cited

U.S. PATENT DOCUMENTS

| | | | |
|---|---|---|---|
| 126,895 | 4/1872 | Metz | 269/152 |
| 138,285 | 7/1873 | Schneiderwind | 269/254 |
| 5,058,869 | 10/1991 | Ruthven | 269/64 |

FOREIGN PATENT DOCUMENTS

| | | | |
|---|---|---|---|
| 15295 | 4/1926 | Netherlands | 269/152 |

*Primary Examiner*—David A. Scherbel
*Assistant Examiner*—Daniel G. Shanley

[57] ABSTRACT

A new clamping device for holding items. The inventive device includes an elongate threaded rod and a plurality of clamp members. Each of the clamp members generally comprises a pair of arms each having a jaw portion, a middle portion, and a handle portion. The pair of arms of the clamp member are pivotally coupled together at the middle portions of the pair of arms with the jaw portions opposing one another. The clamp member has a bore extending between the first and second sides of the clamp member. The first and second sides of the clamp member each also have a cog outwardly extending therefrom around the bore of the clamp member. Each of the cogs of the clamp member has a plurality of teeth. The threaded rod is extended through the bores of the plurality of clamp members such that the clamp members are rotatable about the longitudinal axis of the threaded rod. An end cap is coupled against rotation to one of the ends of the threaded rod. The other end of the threaded rod is threadingly extended through the threaded hole of a tightening end nut so that the plurality of clamping members are positioned between the end cap and tightening end nut.

7 Claims, 2 Drawing Sheets

CLAMPING DEVICE

BACKGROUND OF THE INVENTION

1. Field of the Invention

The present invention relates to clamping tools and more particularly pertains to a new clamping device for holding items.

2. Description of the Prior Art

The use of clamping tools is known in the prior art. More specifically, clamping tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art clamping tools include U.S. Pat. No. 5,381,989; U.S. Pat. No. 4,662,039; U.S. Pat. No. Des. 350,892; U.S. Pat. No. 4,547,092; U.S. Pat. No. 5,303,885; and U.S. Pat. No. Des. 317,116.

While these devices fulfill their respective, particular objectives and requirements, the aforementioned patents do not disclose a new clamping device. The inventive device includes an elongate threaded rod and a plurality of clamp members. Each of the clamp members generally comprises a pair of arms each having a jaw portion, a middle portion, and a handle portion. The pair of arms of the clamp member are pivotally coupled together at the middle portions of the pair of arms with the jaw portions opposing one another. The clamp member has a bore extending between the first and second sides of the clamp member. The first and second sides of the clamp member each also have a cog outwardly extending therefrom around the bore of the clamp member. Each of the cogs of the clamp member has a plurality of teeth. The threaded rod is extended through the bores of the plurality of clamp members such that the clamp members are rotatable about the longitudinal axis of the threaded rod. An end cap is coupled against rotation to one of the ends of the threaded rod. The other end of the threaded rod is threadingly extended through the threaded hole of a tightening end nut so that the plurality of clamping members are positioned between the end cap and tightening end nut.

In these respects, the clamping device according to the present invention substantially departs from the conventional concepts and designs of the prior art, and in so doing provides an apparatus primarily developed for the purpose of holding items.

SUMMARY OF THE INVENTION

In view of the foregoing disadvantages inherent in the known types of clamping tools now present in the prior art, the present invention provides a new clamping device construction wherein the same can be utilized for holding items.

The general purpose of the present invention, which will be described subsequently in greater detail, is to provide a new clamping device apparatus and method which has many of the advantages of the clamping tools mentioned heretofore and many novel features that result in a new clamping device which is not anticipated, rendered obvious, suggested, or even implied by any of the prior art clamping tools, either alone or in any combination thereof.

To attain this, the present invention generally comprises an elongate threaded rod and a plurality of clamp members. Each of the clamp members generally comprises a pair of arms each having a jaw portion, a middle portion, and a handle portion. The pair of arms of the clamp member are pivotally coupled together at the middle portions of the pair of arms with the jaw portions opposing one another. The clamp member has a bore extending between the first and second sides of the clamp member. The first and second sides of the clamp member each also have a cog outwardly extending therefrom around the bore of the clamp member. Each of the cogs of the clamp member has a plurality of teeth. The threaded rod is extended through the bores of the plurality of clamp members such that the clamp members are rotatable about the longitudinal axis of the threaded rod. An end cap is coupled against rotation to one of the ends of the threaded rod. The other end of the threaded rod is threadingly extended through the threaded hole of a tightening end nut so that the plurality of clamping members are positioned between the end cap and tightening end nut.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clamping device apparatus and method which has many of the advantages of the clamping tools mentioned heretofore and many novel features that result in a new clamping device which is not anticipated, rendered obvious, suggested, or even implied by any of the prior art clamping tools, either alone or in any combination thereof.

It is another object of the present invention to provide a new clamping device which may be easily and efficiently manufactured and marketed.

It is a further object of the present invention to provide a new clamping device which is of a durable and reliable construction.

An even further object of the present invention is to provide a new clamping device which is susceptible of a low cost of manufacture with regard to both materials and labor, and which accordingly is then susceptible of low prices of sale to the consuming public, thereby making such clamping device economically available to the buying public.

Still yet another object of the present invention is to provide a new clamping device which provides in the apparatuses and methods of the prior art some of the advantages thereof, while simultaneously overcoming some of the disadvantages normally associated therewith.

Still another object of the present invention is to provide a new clamping device for holding items.

Yet another object of the present invention is to provide a new clamping device which includes an elongate threaded rod and a plurality of clamp members. Each of the clamp members generally comprises a pair of arms each having a jaw portion, a middle portion, and a handle portion. The pair of arms of the clamp member are pivotally coupled together at the middle portions of the pair of arms with the jaw portions opposing one another. The clamp member has a bore extending between the first and second sides of the clamp member. The first and second sides of the clamp member each also have a cog outwardly extending therefrom around the bore of the clamp member. Each of the cogs of the clamp member has a plurality of teeth. The threaded rod is extended through the bores of the plurality of clamp members such that the clamp members are rotatable about the longitudinal axis of the threaded rod. An end cap is coupled against rotation to one of the ends of the threaded rod. The other end of the threaded rod is threadingly extended through the threaded hole of a tightening end nut so that the plurality of clamping members are positioned between the end cap and tightening end nut.

Still yet another object of the present invention is to provide a new clamping device that allows a user to hold multiple items at fixed relative positions to one another. For example the clamping device allows a heat shield to be held in position when wielding two other objects held by the device.

Even still another object of the present invention is to provide a new clamping device that may be clamped to fixed structures to act as a portable vice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
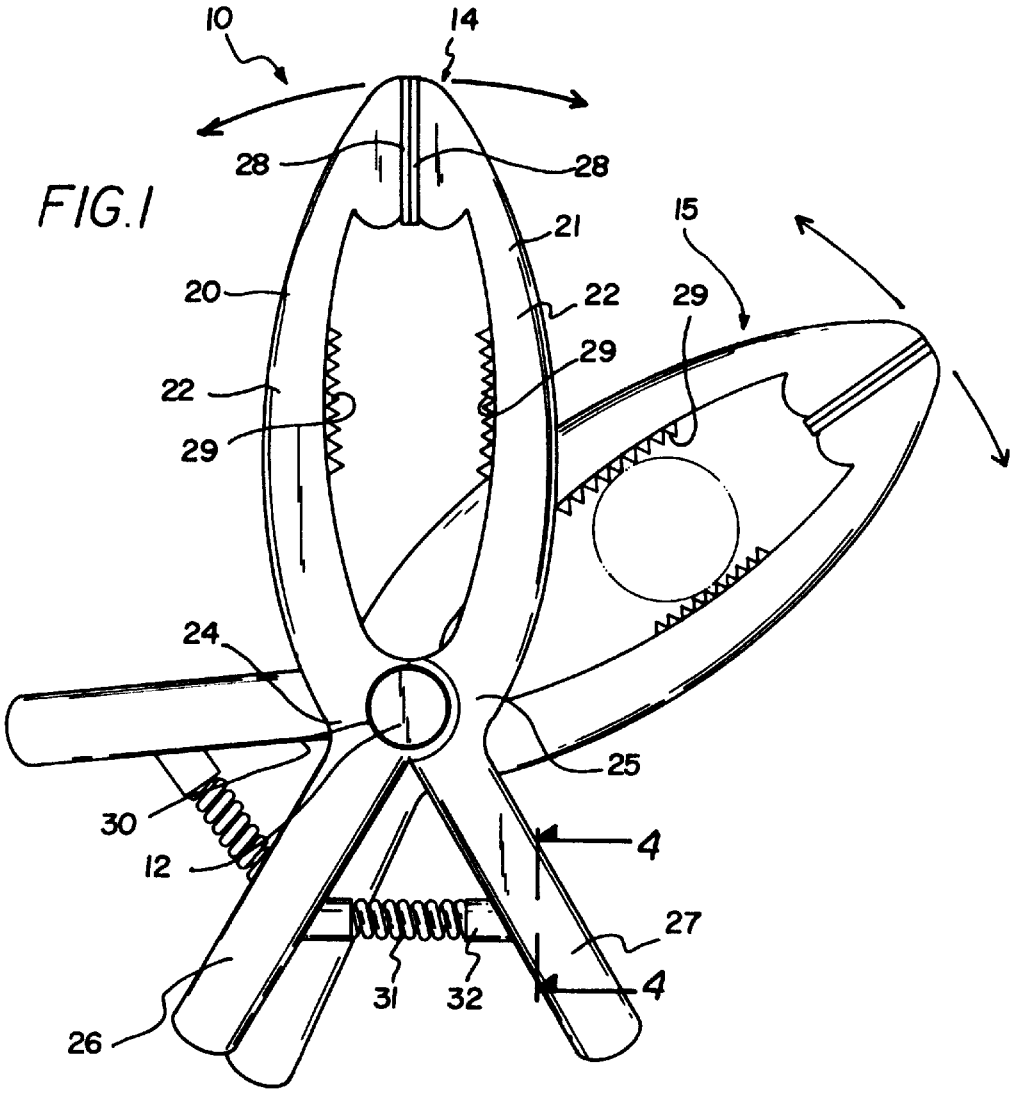
FIG. 1 is a schematic side view of a new clamping device in use according to the present invention with one clamping member holding a pipe and orientated at an angle with respect to the other clamping member.

With reference now to the drawings, and in particular to FIGS. 1 through 4 thereof, a new clamping device embodying the principles and concepts of the present invention and generally designated by the reference numeral 10 will be described.

As best illustrated in FIGS. 1 through 4, the clamping device 10 generally comprises an elongate threaded rod 12 and a plurality of clamp members 14,15,16,17,18. Each of the clamp members generally comprises a pair of arms 20,21 each having a jaw portion 22,23, a middle portion 24,25, and a handle portion 26,27. The pair of arms 20,21 of the clamp member are pivotally coupled together at the middle portions 24,25 of the pair of arms 20,21 with the jaw portions 22,23 opposing one another. The clamp member has a bore 30 extending between the first and second sides of the clamp member. The first and second sides of the clamp member each also have a cog 34,35 outwardly extending therefrom around the bore 30 of the clamp member. Each of the cogs 34,35 of the clamp member has a plurality of teeth. The threaded rod 12 is extended through the bores 30 of the plurality of clamp members 14,15,16,17,18 such that the clamp members are rotatable about the longitudinal axis of the threaded rod 12. An end cap 36 is coupled against rotation to one of the ends of the threaded rod 12. The other end of the threaded rod 12 is threadingly extended through the threaded hole of a tightening end nut 38 so that the plurality of clamping members are positioned between the end cap 36 and tightening end nut 38.

In closer detail, the clamp members 14,15,16,17,18 are preferably a type of spring clamp and each includes first and second sides, and a pair of opposing arms 20,21. Each arm 20,21 has a jaw portion 22,23, a middle portion 24,25, and a handle portion 26,27. The pair of arms 20,21 of the clamp member arc pivotally coupled together at their middle portions 24,25 with the jaw portions 22,23 opposing one another. Optionally, one of the clamp members has jaw portions 22,23 shorter than the jaw portions 22,23 of the other clamp members, the shorter jaw portioned clamp member is designed for holding items closer than items held by the other clamp members.

Figure 2:
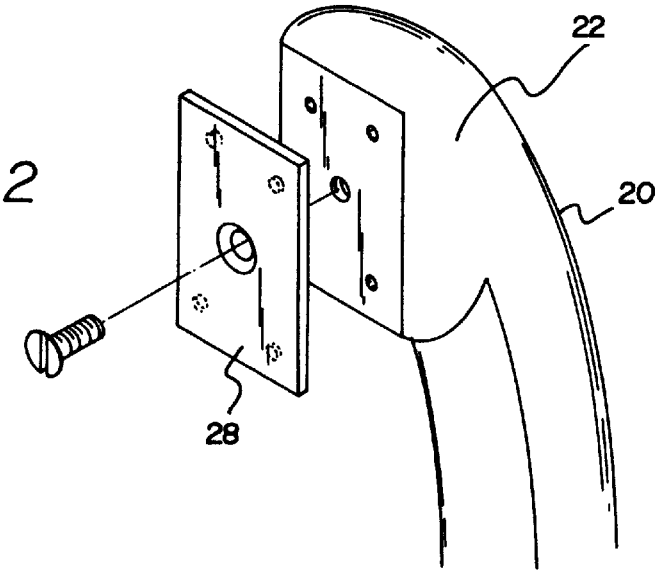
FIG. 2 is a schematic exploded perspective view of a clamping pad of the present invention.

Preferably, as shown in FIG. 2, each of the jaw portions 22,23 has a clamping pad 28 coupled thereto at one end so that the clamping pads 28 of the arms of the clamp member face each other. The clamping pads 28 of the clamp member are designed for holding an item therebetween. The clamping pads may be smooth or optionally have a grooved or toothed surface for helping hold items therebetween.

With reference to FIG. 1, each of the jaw portions 22,23 of the arms 20,21 of the clamp member ideally has a plurality of gripping teeth 29 with the gripping teeth of the jaw of one of the arms of the clamp member facing the gripping teeth of the jaw of the other arm. The gripping teeth 29 are positioned between the clamping pads 28 and the middle portions 24,25 of the arms 20,21. The gripping teeth 29 of the arms 20,21 are designed for holding an item such as a pipe between them.

The jaw portions 22,23 of the arms 20,21 are biased towards one another, preferably, by a spring 31. As shown in FIG. 1, the spring 31 is extended between the handle portions 26,27 of the arms 20,21. Ideally, the biasing tension provided by the spring 31 is adjustable by a threaded sleeve 32 at one end of the spring 31 which is threadingly extended through a corresponding threaded hole in the handle portion 27 of one of the arms 21 of the clamp member. The threaded sleeve 32 has a slot 33 for inserting the tip of a screwdriver therein for tightening or releasing the amount of biasing tension provided by the spring 31.

The clamp member has a bore 30 extending between the first and second sides of the clamp member and is positioned at the middle portions 24,25 of the arms 20,21. The first and second sides of the clamp member each have a generally circular cog 34,35 outwardly extending therefrom around the periphery of the bore 30. Each of the cogs 34,35 of the clamp member is shaped similar to a hole saw drill bit and has a plurality of teeth.

Figure 3:
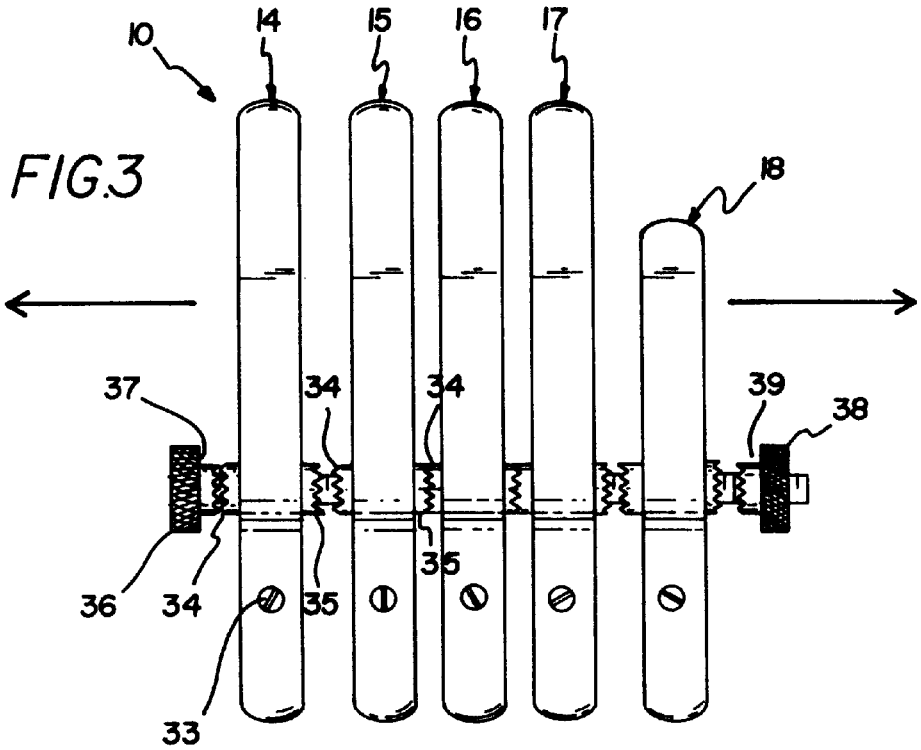
FIG. 3 is a schematic side view of the present invention.
Figure 4:
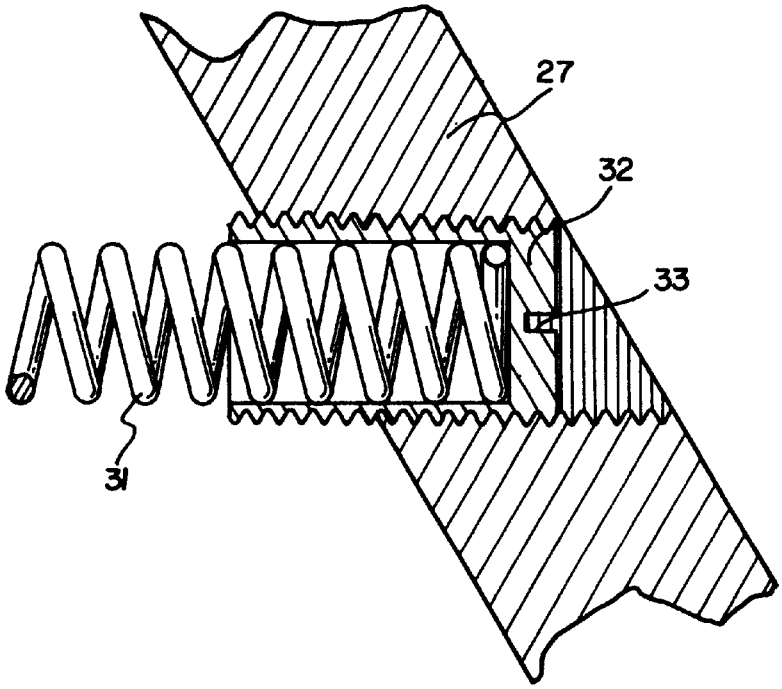
FIG. 4 is a schematic sectional view of the present invention taken from line 4—4 on FIG. 1.

The elongate threaded rod 12 has a pair of opposite ends with its longitudinal axis extending between the ends. The threaded rod 12 is extended through the bores 30 of the plurality of clamp members 14,15,16,17,18 such that the clamp members are rotatable about the longitudinal axis of the threaded rod 12. As illustrated in FIG. 3, the clamp members are arranged in a row along the longitudinal axis of the threaded rod 12 such that the first side of one adjacent clamping member faces the second side of the other adjacent clamping member and the lengths of each of the clamp members are extended substantially perpendicular to the longitudinal axis of the threaded rod 12.

An end cap 36 designed for gripping by a user is fixedly coupled against rotation to one of the ends of the threaded rod 12. The end cap 36 has an end cap cog 37 with a plurality of teeth. The end cap cog 37 is extended from the end cap 36 towards another end of the threaded rod 12 such that the teeth of the end cap cog 37 face the other end of the threaded rod 12. The other end of the threaded rod 12 is threadingly extended through the threaded hole of a tightening end nut 38 such that the tightening end nut 38 may be tightened towards the one end of the threaded rod 12. The tightening end nut 38 has an end nut cog 39 with a plurality of teeth that are extended from the tightening end nut 38 towards the one end of the threaded rod 12 such that the teeth of the end cap cog 37 face the one end of the threaded rod 12. The plurality of clamping members are positioned between the end cap 36 and tightening end nut 38. Ideally, the end cap 36 and the tightening end nut 38 each have frictionally enhanced outer surfaces with respect to a smooth surface such as a knurled surface.

In use, the clamps members are forced together between the end cap 36 and the tightening end nut 38 when the tightening nut is advanced on the threaded rod 12 towards the end cap 36 such that the teeth of a cog engage the teeth of an adjacent cog such that the clamping members are held in a position relative to each other on the threaded rod 12. As shown in FIG. 1, this allows one clamping member to be extended from said threaded rod at a different angle than another clamping member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clamping device, comprising:

an elongate rod having a pair of opposite ends and a longitudinal axis being extended between said ends of said threaded rod;

a plurality of clamp members, wherein each of said clamp members comprises:

first and second sides, and a pair of arms each having a jaw portion, a middle portion, and a handle portion;

said pair of arms of said clamp member being pivotally coupled together at said middle portions of said pair of arms, said jaw portions of said pair of arms of said clamp member opposing one another;

said clamp member having a bore being extended between said first and second sides of said clamp member and being positioned at said middle portions of said arms, said pair of arms pivoting about said bore;

said first and second sides of said clamp member each having a cog outwardly extending therefrom around said bore of said clamp member, each of said cogs of said clamp member having a plurality of teeth;

said rod being extended through each of said bores of said plurality of clamp members such that each of said clamp members are rotatable about a common axis, said common axis comprising said longitudinal axis of said rod, said clamp members being arranged in a row along said longitudinal axis of said rod such that each of said clamp members in said row are pivotable about the common axis;

an end cap being coupled to one of said ends of said threaded rod, said end cap having an end cap cog, said end cap cog having a plurality of teeth, said end cap cog being extended from said end cap towards another end of said threaded rod such that said teeth of said end cap cog face said other end of said threaded rod;

a tightening end nut having a threaded hole therethrough, said other end of said threaded rod being threadingly extended through said threaded hole of said tightening end nut, said tightening end nut having an end nut cog, said end nut cog having a plurality of teeth, said end nut cog being extended from said tightening end nut towards said one end of said threaded rod such that said teeth of said end cap cog face said one end of said threaded rod, said plurality of clamping members being positioned between said end cap and tightening end nut; and wherein each of said jaw portions of said arms of said clamp member has a plurality of gripping teeth, said gripping teeth of the jaw of one of the arms of said clamp member facing said gripping teeth of the jaw of the other arm of said clamp member, said gripping teeth being positioned between said clamping pads and said middle portions of said arms of said clamping member, said gripping teeth of the arms being for holding an item therebetween.

2. The clamping device of claim 1, wherein each of said jaw portions of said arms of said clamp member has a clamping pad coupled thereto, said clamping pads of said clamp member facing each other.

3. The clamping device of claim 1, wherein said jaw portions of said arms of said clamp member are biased towards one another.

4. The clamping device of claim 3, wherein a spring biases said jaw portions of said arms of said clamp member towards one another, said spring being extended between said handle portions of said arms of said clamp member.

5. The clamping device of claim 4, wherein the biasing tension provided by said spring is adjustable by a threaded sleeve at one end of said spring, said threaded sleeve being threadbly extendable through a corresponding threaded hole in said handle portion of one of said arms of said clamp member, said threaded sleeve having a slot for inserting a tip of a screwdriver therein for tightening or releasing the amount of biasing tension provided by the spring.

6. A clamping device, comprising:

an elongate threaded rod having a pair of opposite ends and a longitudinal axis being extended between said ends of said threaded rod;

a plurality of clamp members, wherein each of said clamp members comprises:

first and second sides, and a pair of arms each having a jaw portion, a middle portion, and a handle portion;

said pair of arms of said clamp member being pivotally coupled together at said middle portions of said pair of arms, said jaw portions of said pair of arms of said clamp member opposing one another;

each of said jaw portions of said arms of said clamp member having a clamping pad coupled thereto, said clamping pads of said clamp member facing each other;

each of said jaw portions of said arms of said clamp member having a plurality of gripping teeth, said gripping teeth of the jaw of one of the arms of said clamp member facing said gripping teeth of the jaw of the other arm of said clamp member, said gripping teeth being positioned between said clamping pads and said middle portions of said arms of said clamping member, said gripping teeth of the arms being for holding an item therebetween;

said jaw portions of said arms of said clamp member being biased towards one another, wherein a spring biases said jaw portions of said arms of said clamp member towards one another, said spring being extended between said handle portions of said arms of said clamp member, wherein the biasing tension provided by said spring is adjustable by a threaded sleeve at one end of said spring, said threaded sleeve being threadbly extendable through a corresponding threaded hole in said handle portion of one of said arms of said clamp member, said threaded sleeve having a slot for inserting a tip of a screwdriver therein for tightening or releasing the amount of biasing tension provided by the spring;

said clamp member having a bore being extended between said first and second sides of said clamp member and being positioned at said middle portions of said arms;

said first and second sides of said clamp member each having a generally circular cog outwardly extending therefrom around said bore of said clamp member, each of said cogs of said clamp member having a plurality of teeth;

said threaded rod being extended through said bores of said plurality of clamp members such that said clamp members are rotatable about said longitudinal axis of said threaded rod, said clamp members being arranged in a row along said longitudinal axis of said threaded rod, each of said clamp members being extended substantially perpendicular to said longitudinal axis of said threaded rod;

an end cap being coupled to one of said ends of said threaded rod, said end cap having an end cap cog, said end cap cog having a plurality of teeth, said end cap cog being extended from said end cap towards another end of said threaded rod such that said teeth of said end cap cog face said other end of said threaded rod;

a tightening end nut having a threaded hole therethrough, said other end of said threaded rod being threadingly extended through said threaded hole of said tightening end nut, said tightening end nut having an end nut cog, said end nut cog having a plurality of teeth, said end nut cog being extended from said tightening end nut towards said one end of said threaded rod such that said teeth of said end cap cog face said one end of said threaded rod, said plurality of clamping members being positioned between said end cap and tightening end nut; and wherein said clamps are forced together when said tightening nut is advanced on said threaded rod towards said end cap such that the teeth of a cog engage the teeth of an adjacent cog such that said clamping members are held in a position relative to each other on said threaded rod.

7. A clamping device, comprising:

an elongate rod having a pair of opposite ends and a longitudinal axis being extended between said ends of said threaded rod;

a plurality of clamp members, wherein each of said clamp members comprises:

first and second sides, and a pair of arms each having a jaw portion, a middle portion, and a handle portion;

said pair of arms of said clamp member being pivotally coupled together at said middle portions of said pair of arms, said jaw portions of said pair of arms of said clamp member opposing one another;

said clamp member having a bore being extended between said first and second sides of said clamp member and being positioned at said middle portions of said arms, said pair of arms pivoting about said bore; and said rod being extended through each of said bores of said plurality of clamp members such that each of said clamp members are rotatable about a common axis, said common axis comprising said longitudinal axis of said rod, said clamp members being arranged in a row along said longitudinal axis of said rod such that each of said clamp members in said row are pivotable about the common axis.

* * * * *